US009012825B2

(12) United States Patent
Plumer et al.

(10) Patent No.: US 9,012,825 B2
(45) Date of Patent: Apr. 21, 2015

(54) SYSTEMS AND METHODS FOR RETAINING AND DEPLOYING CANARDS

(71) Applicant: Simmonds Precision Products, Inc., Vergennes, VT (US)

(72) Inventors: Matt Plumer, Huntington, VT (US); Jeff Gibson, Vergennes, VT (US); Jim Byrne, Williston, VT (US); Brian Richardson, Shelburne, VT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 187 days.

(21) Appl. No.: 13/748,250

(22) Filed: Jan. 23, 2013

(65) Prior Publication Data

US 2014/0203134 A1 Jul. 24, 2014

(51) Int. Cl.

| | |
|---|---|
| ***F42B 10/14*** | (2006.01) |
| ***B64C 9/36*** | (2006.01) |
| ***F42B 10/64*** | (2006.01) |
| *F42B 10/00* | (2006.01) |
| *B64C 9/00* | (2006.01) |

(52) U.S. Cl.

CPC ..... *F42B 10/00* (2013.01); *F42B 10/14* (2013.01); *F42B 10/64* (2013.01)

(58) Field of Classification Search

CPC ..... F42B 10/00; F42B 10/02; F42B 10/14; F42B 10/60; F42B 10/62; F42B 10/64

USPC ..... 244/3.1–3.3, 34 R, 35 R, 45 R, 46, 49

See application file for complete search history.

(56) References Cited

U.S. PATENT DOCUMENTS

| | | | | |
|---|---|---|---|---|
| 4,512,537 | A | 4/1985 | Sebestyen et al. | |
| 4,607,810 | A | 8/1986 | Frazer | |
| 6,446,906 | B1 * | 9/2002 | Voigt et al. | 244/3.27 |
| 6,880,780 | B1 | 4/2005 | Perry et al. | |
| 7,163,176 | B1 | 1/2007 | Geswender et al. | |
| 7,354,017 | B2 | 4/2008 | Morris et al. | |
| 7,412,930 | B2 | 8/2008 | Smith et al. | |
| 8,319,164 | B2 * | 11/2012 | Martinez | 244/3.27 |
| 8,552,351 | B2 * | 10/2013 | Geswender et al. | 244/3.27 |
| 2010/0288870 | A1 | 11/2010 | Geswender et al. | |
| 2011/0297783 | A1 | 12/2011 | Martinez | |

* cited by examiner

*Primary Examiner* — Bernarr Gregory

(74) *Attorney, Agent, or Firm* — Locke Lord LLP; Scott D. Wofsy; Alicia J. Esposito

(57) ABSTRACT

Disclosed are systems and methods for retaining and deploying a plurality of canards and canard covers on a projectile. The projectile includes a projectile housing defining an interior chamber and a longitudinal axis, canards rotatably mounted to the housing, canard covers, a bobbin movably disposed in the interior chamber of the housing along the longitudinal axis, and rocker arms. The canards mounted for movement from a stowed position to a deployed position. The canard covers have a hook element and are adapted to cover respective slots formed in the housing. The bobbin has first and second ends and a retaining surface proximate the second end. Rocker arms have a first and second arm end, with a canard retaining slot defined therebetween. The first arm end includes a latch element for engaging with the canard cover element, and the second arm end is positioned proximate the retaining surface.

20 Claims, 7 Drawing Sheets

Fig. 1
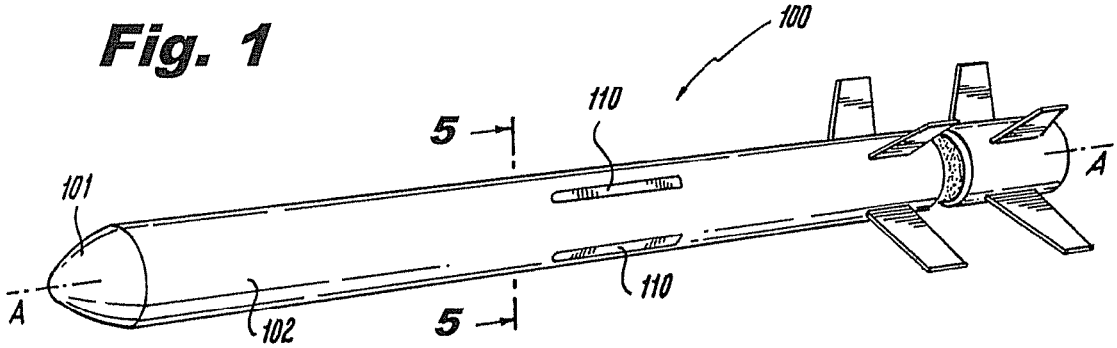
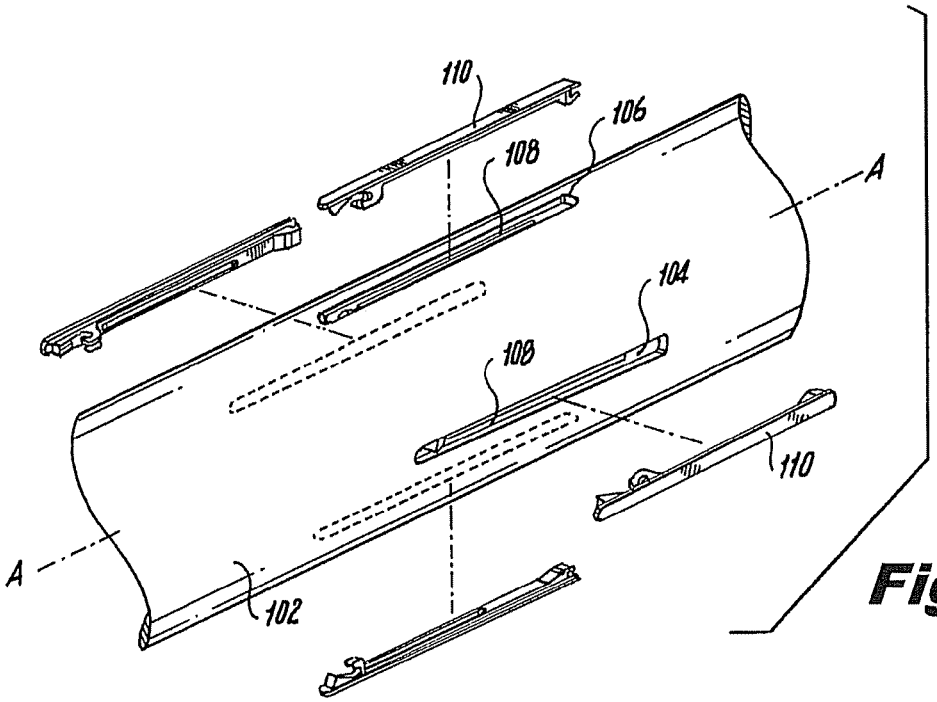
Fig. 2
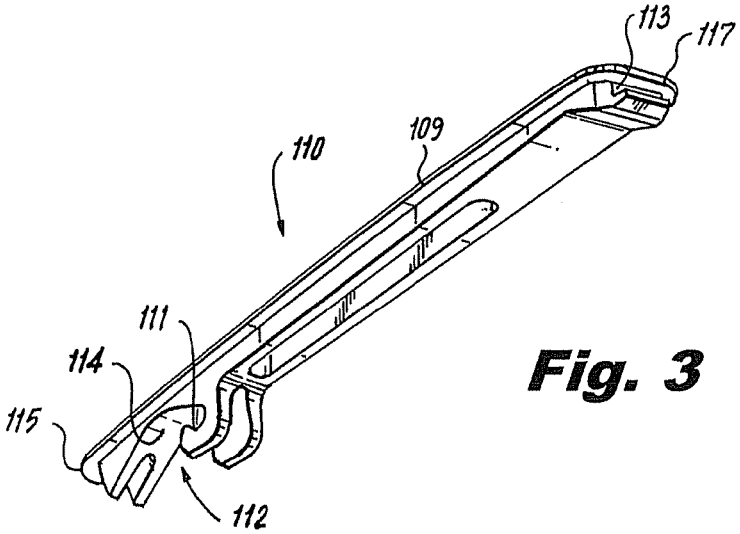
Fig. 3

Fig. 4
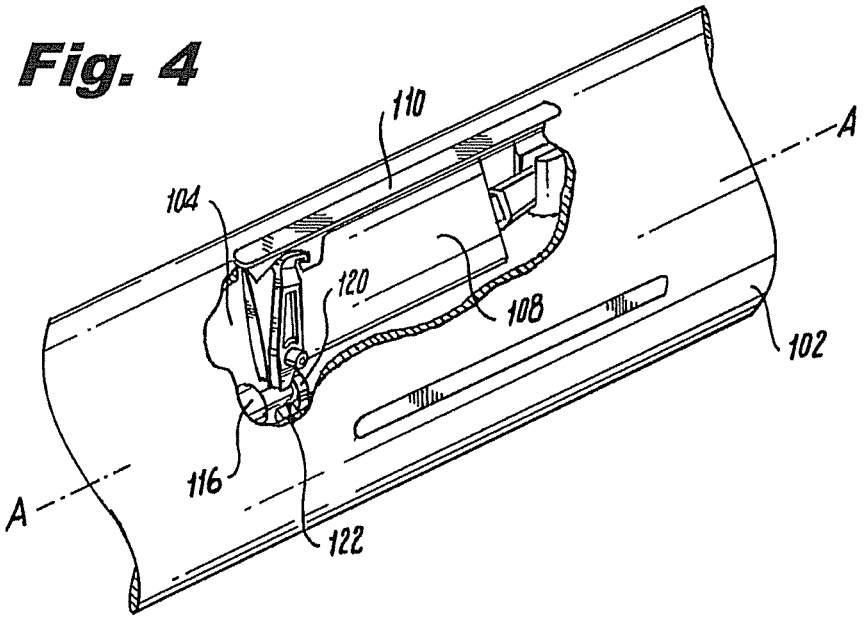
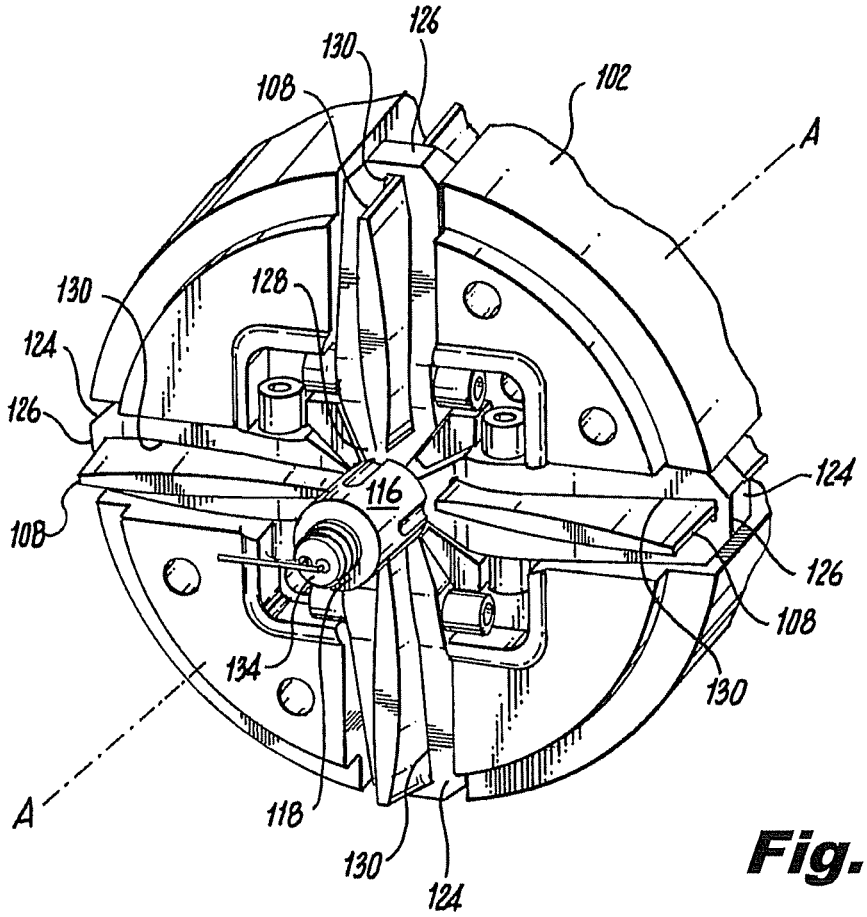
Fig. 5

SYSTEMS AND METHODS FOR RETAINING AND DEPLOYING CANARDS

BACKGROUND OF THE INVENTION

1. Field of the Invention

The invention relates to retention and deployment systems for canards and more particularly to systems and methods for retaining and deploying canards and canard covers on a projectile.

2. Description of Related Art

During the launch of a projectile it is desired to have retractable canards which are retained within the projectile and subsequent to launch the canards unfold from within the projectile and extend into the airstream. Slots in the projectile housing are provided to accommodate deployment of the canards from within the projectile to the outside airstream. These slots increase drag on the projectile, reducing the range for the projectile launch, and expose the inner components to environmental conditions, such as electromagnetic interference. To solve these problems, slot covers can be used.

Existing mechanisms for canard cover ejection and canard deployment on launched projectiles are known in the art. In the past, mechanisms for canard deployment typically employ multiple pyrotechnics to eject the canard cover and additional spring-loaded mechanisms to deploy the canards. Using separate pyrotechnics and spring-loaded mechanisms to eject the covers and deploy the canards makes it difficult to synchronize the deployment of the canards, therein creating instability if one canard deploys before another, and increases the cost and the complexity of the deploying mechanism.

More recently, efforts have been made to deploy canards using a single pyrotechnic device, for example, as disclosed in U.S. Pat. No. 6,880,780 to Perry et al. (hereinafter, 'Perry'). Perry discloses an apparatus using covers for controlled storage and deployment of the steering fins of a missile. The covers in Perry serve to prevent the fins from deployment while also providing an aerodynamic fairing. As part of the apparatus, Perry discloses rotatable latch arms for securing the covers. The disclosed rotatable latch arm includes parallel latch arm portions on opposite sides of the fin. The latch arm portions are joined together at only one end forming an open slot. The fins remain in the slot while being retained by the cover. But, when the cover is removed, the fins deploy. This design does not account for situations where the covers are accidentally ejected during or after launch, but before it is desired to have the canards released. When the covers are accidentally ejected and canards accidentally released, control over the projectile can be lost. In addition, to radially project the cover using the latch arm of Perry, a separate extending forward portion of the latch arm is positioned to contact an inwardly extending portion of the cover. This added geometry takes up additional space, adds complexity to manufacturing and uses more material, which adds weight and cost.

Such conventional methods and systems have generally been considered satisfactory for their intended purpose. However, there is still a need in the art for systems and methods that allow for improved performance, and a retaining and deployment system that is easy to make, use and test. Therefore, it would be advantageous to provide systems and methods for retaining and deploying canards and canard covers that overcome the disadvantages associated with traditional canard retaining and deploying systems and methods and solves the challenges associated with such traditional systems and methods, such as accidental canard deployment. The present invention provides a solution to these problems.

SUMMARY OF THE INVENTION

The subject invention is directed to a new and useful system for retaining and deploying a plurality of canards and canard covers on a projectile. The system includes a projectile housing defining an interior chamber and a longitudinal axis, and a plurality of canards rotatably mounted to the housing. The plurality of canards are adapted for movement from a stowed position within the housing to a deployed position. The system further includes a plurality of canard covers. Each canard cover is adapted to conceal respective slots formed in the projectile housing and includes a hook element. The system also includes a bobbin and a plurality of rocker arms, the rocker arms rotatably mounted within the housing. The bobbin is movably disposed in the interior chamber of the housing along the longitudinal axis of the projectile housing and has first and second ends, and a retaining surface defined proximate the second end. Each rocker arm has a first arm end and a second arm end, with a canard retaining slot defined therebetween configured to secure a canard in the stowed position. The first arm end includes a latch element and the second arm end is positioned proximate the bobbin retaining surface. The system also includes a mechanism for driving the bobbin axially along the longitudinal axis, so as to deploy the plurality of canards and canard covers on the projectile.

Preferably, each rocker arm can be configured and adapted to rotate relative to a rocker arm rotation axis between a first and second position. Each latch element can include a cover retaining surface, wherein in the first position the cover retaining surface can be engaged with a corresponding internal surface of canard cover hook element and each second arm end can be engaged with the bobbin retaining surface. The cover retaining surface can be configured and adapted to retain the corresponding canard cover over its respective slot formed in the projectile housing. Each rocker arm can be forced to rotate relative to its respective rocker aim rotation axis into the second position, from the first position, when the bobbin is moved along the longitudinal axis relative to the projectile housing. During rotation from the first position to the second position, a cover ejection surface of the latch element of the rocker arm ejects the canard cover and the canard retaining slot releases the canards. In addition, in a preferred embodiment, a surface formed on each rocker arm proximate the second arm end is configured and adapted to mechanically push the associated canard into the deployed position when the rocker arm rotates relative to its respective rocker arm rotation axis.

In further accordance with certain embodiments, each of the canard cover hook elements has a cammed surface and an internal surface. Each of the canard covers also includes a main body section having forward and aft ends and a groove proximate the aft end. The groove is removably engaged with projectile housing, and the canard cover hook element, as previously described, is defined between the forward and aft ends, proximate the forward end. Each of the canard covers is configured to eliminate drag on the projectile housing.

In further accordance with certain embodiments, the mechanism for driving the bobbin can be a pyrotechnic component disposed within an axial bore formed within the first end of the bobbin. The pyrotechnic component can be configured and adapted to initiate a force on the bobbin which causes the bobbin to move along the longitudinal axis relative to the projectile housing. The axial movement of the bobbin can be translated into a force on the second arm end of each rocker arm causing the rotation of each rocker arm relative to a respective rocker arm rotation axis from it's the first position to the second position. The system can also include an absorber disposed proximate to the second end of the bobbin along the longitudinal axis, which is configured and adapted to reduce shock to the projectile housing during deployment. The absorber can be a crushable replaceable absorber.

Preferably, each canard can be configured and adapted to rotate about a respective fulcrum and in a respective plane passing through the longitudinal axis. The canards can be configured to be released and deployed simultaneously with one another. Also, the system can be disposed in a tip portion of the projectile housing. It is also envisioned that each canard can be locked along a respective transverse axis in the deployed position. Each canard can be configured to rotate through the respective slots described above, from the stowed position within the housing, into the deployed position.

The invention also provides a method for ejecting a plurality of canard covers and deploying a plurality of canards on a projectile. The method includes driving a bobbin disposed within an interior chamber formed in the projectile longitudinally so as to cause a plurality of rocker arms to rotate about a respective rocker arm axis. Each rocker arm defines a canard retaining slot configured to secure the canard in a stowed position. The rotation of the rocker arms causes the ejection of the plurality of canard covers and the subsequent mechanically timed release and deployment of the plurality of canards.

In further accordance with certain embodiments, the release and deployment of each of the canards can be simultaneous with one another.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the systems and methods of the subject invention without undue experimentation, preferred embodiments thereof will be described in detail herein below with reference to certain figures, wherein:

FIG. 1 is a perspective view of a projectile constructed in accordance with the present invention, showing the projectile in the closed position;

FIG. 2 is an enlarged expanded view of the projectile shown in FIG. 1, wherein the canard covers have been removed in order to view the canards in the closed position;

FIG. 3 is an enlarged perspective view of a canard cover constructed in accordance with an embodiment of the present invention, showing the canard cover hook element with a cammed surface and internal surface;

FIG. 4 is a cut-away perspective view of the projectile shown in FIG. 1, showing a system for retaining and deploying a plurality of canards and canard covers in accordance with an embodiment of the present invention;

FIG. 5 is a cross-sectional view of the projectile shown in FIG. 1, showing a system for retaining and deploying a plurality of canards and canard covers in accordance with an embodiment of the present invention;

Figure 6:
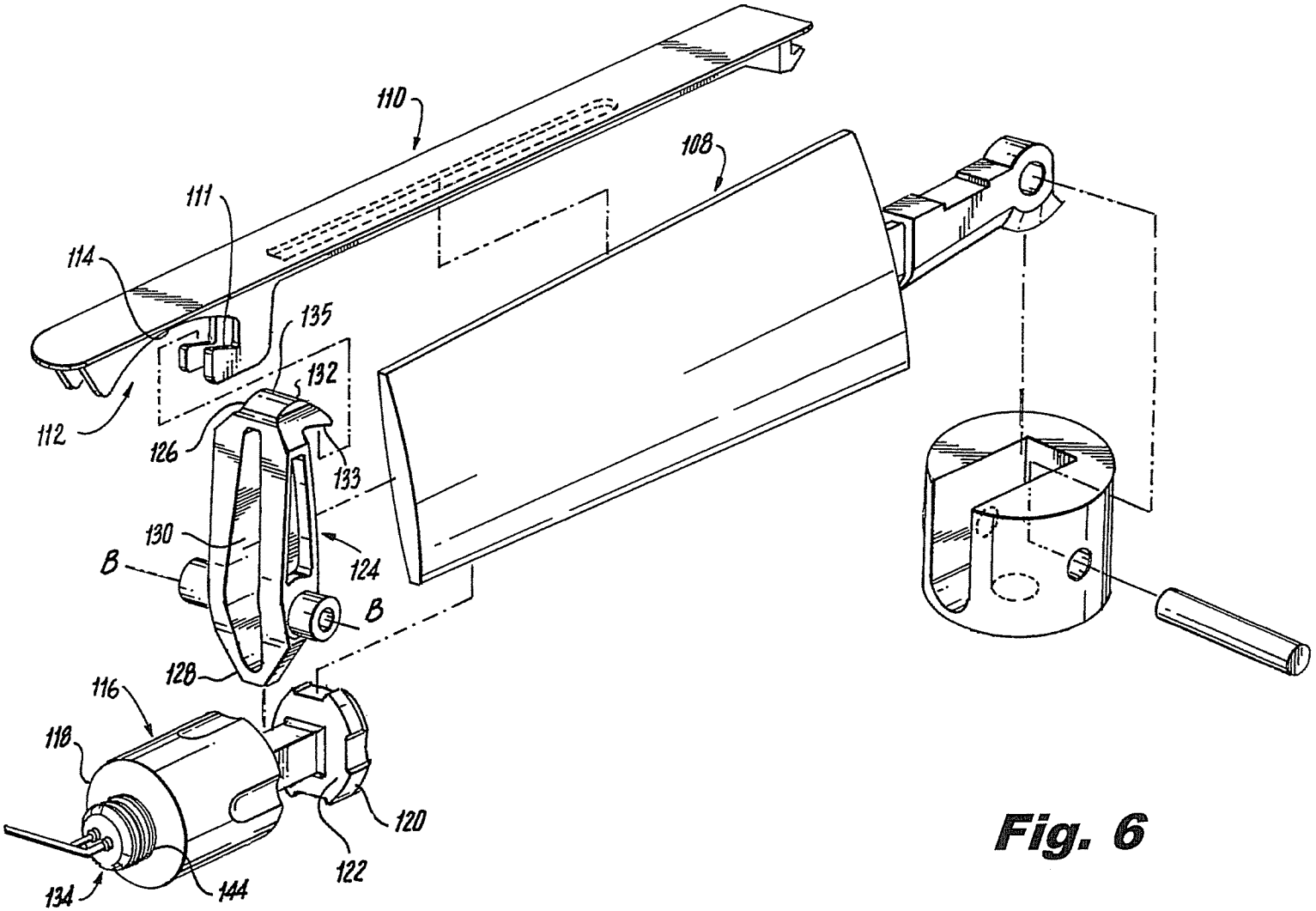
FIG. 6 is an expanded assembly view of a system for retaining and deploying a plurality of canards and canard covers which has been constructed in accordance with an embodiment of the present invention.

These and other aspects of the subject invention will become more readily apparent to those having ordinary skill in the art from the following detailed description of the invention taken in conjunction with the drawings.

DETAILED DESCRIPTION OF THE PREFERRED EMBODIMENTS

Reference will now be made to the drawings wherein like reference numerals identify similar structural features or aspects of the subject invention. For purposes of explanation and illustration, and not limitation, a partial view of an exemplary embodiment of the system for retaining and deploying a plurality of canards and canard covers on a projectile in accordance with the invention is shown in FIG. 1 and is designated generally by reference character 100. Other details of the system and methods are provided in FIGS. 2-11, as will be described.

Referring now to FIGS. 1 and 2, system 100 includes a projectile housing 102 which defines an interior chamber 104 and a longitudinal axis A. As shown in FIG. 1, system 100 further includes a plurality of canard covers 110. As shown in FIG. 2, each canard cover 110 is adapted to conceal respective slots 106 formed in projectile housing 102. System 100 also includes a plurality of canards 108 rotatably mounted to housing 102. Canards 108 are configured and adapted to rotate about a respective fulcrum and in a respective plane, from a stowed position, as shown in FIG. 2, within housing 102, to a deployed position. Canards 108 rotate through respective slots 106 from the stowed position to the deployed position. The deployed position is described below with reference to FIGS. 10 and 11.

While shown in the exemplary context of having four canards 108 and corresponding canard covers 110, those skilled in the art will readily appreciate that any plurality of canards 108 and canard covers 110 can be used. In addition, those skilled in the art will readily appreciate that canard covers 110 and canards 108 can be placed in various locations on projectile housing 102, for example, canards can be disposed in or around a tip portion 101 of projectile housing 102. Those having skill in the art will also readily appreciate that the embodiments described herein can be used with any type of projectile requiring deployed canard or fin structures, for example, any control surface introduced to the air or fluid stream.

Referring now to FIG. 3, each canard cover 110 includes a hook element 112 with a cammed surface 114 and an internal surface 111. Cover 110 also includes a main body section 109 with forward and aft ends 115, 117, respectively. Hook element 112 is defined between forward and aft ends 115, 117, proximate forward end 115. Cover further includes a groove 113 proximate aft end 117. Groove 113 is engaged with projectile housing 102 in the closed position. By covering their respective slots 106 during launch, canard covers 110 eliminate drag on the projectile, therein extending the projectile range. In addition, by covering slots 106 canard covers 110 provide protection for components within the projectile housing 102 against mechanical and electromagnetic interference and environmental conditions.

With reference now to FIGS. 4 and 5, system 100 also includes a bobbin 116 movably disposed in interior chamber 104 and along longitudinal axis A of projectile housing 102. Bobbin 116 has a first end 118, as shown in FIG. 5, and a second end 120, as shown in FIG. 4. Bobbin 116 includes a retaining surface defined 122 proximate second end 120.

Referring now to FIGS. 5 and 6, each rocker arm 124 has a first atm end 126 and a second arm end 128, with a canard retaining slot 130 defined therebetween configured to secure canard 108 in the stowed position. First arm end 126 includes a latch element 132 for engaging with canard cover hook element 112 and retaining canard cover 110 over respective slots 106 formed in projectile housing 102, and second arm end 128 is engaged with bobbin retaining surface 122. Latch element 132 includes a cover retaining surface 133 and a cover ejection surface 135. System 100 also includes a mechanism 134 for driving bobbin 116 axially vertical along longitudinal axis A.

Figure 7:
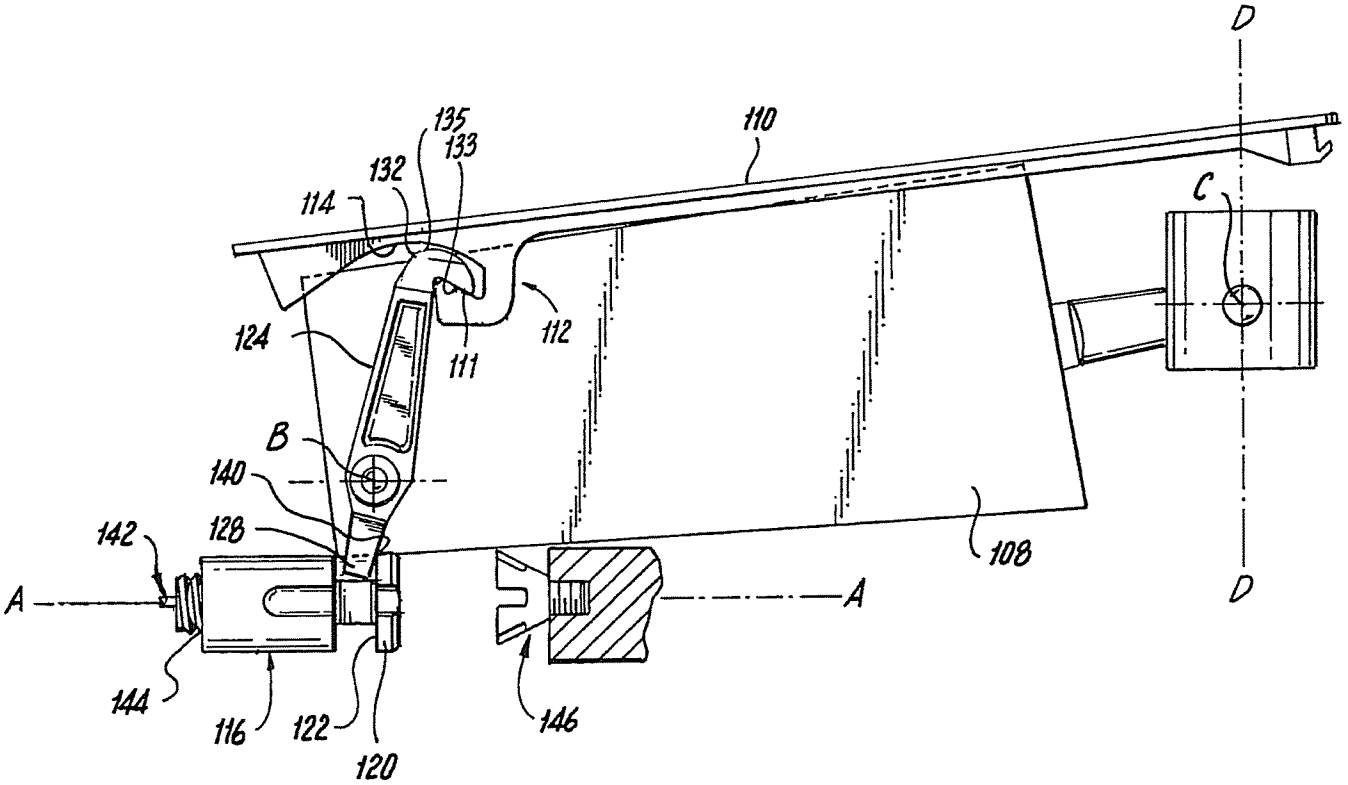
FIG. 7 is a side elevation view of an exemplary embodiment of a system for retaining and deploying a plurality of canards in accordance with the present invention, showing components of the system.
Figure 10:
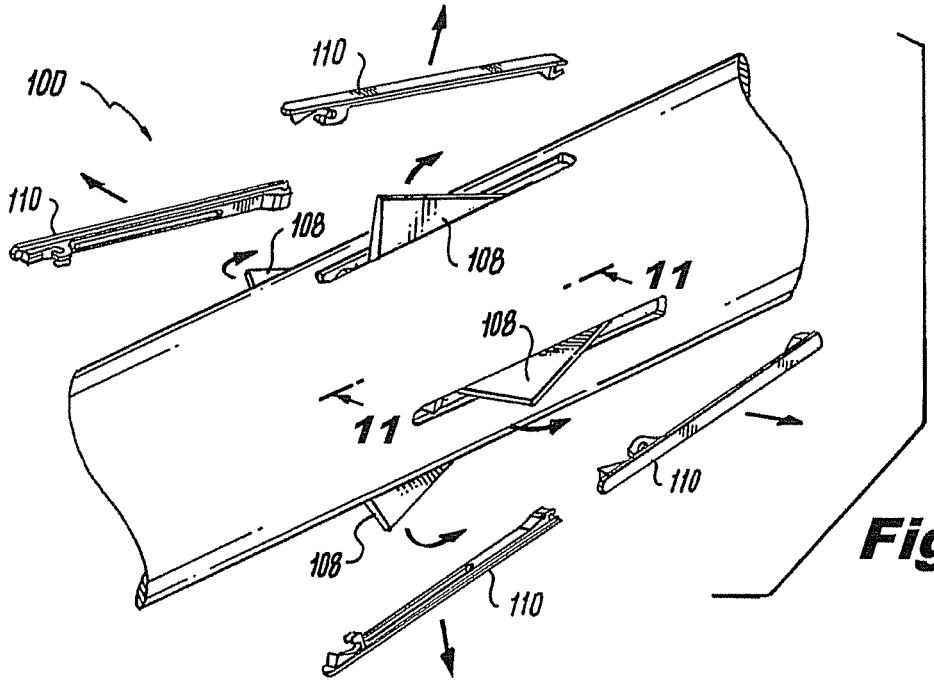
FIG. 10 is an enlarged perspective view of an projectile with a system for retaining and deploying a plurality of canards constructed in accordance with embodiment present invention, showing the canard covers ejected and the canards partially deployed.
Figure 11:
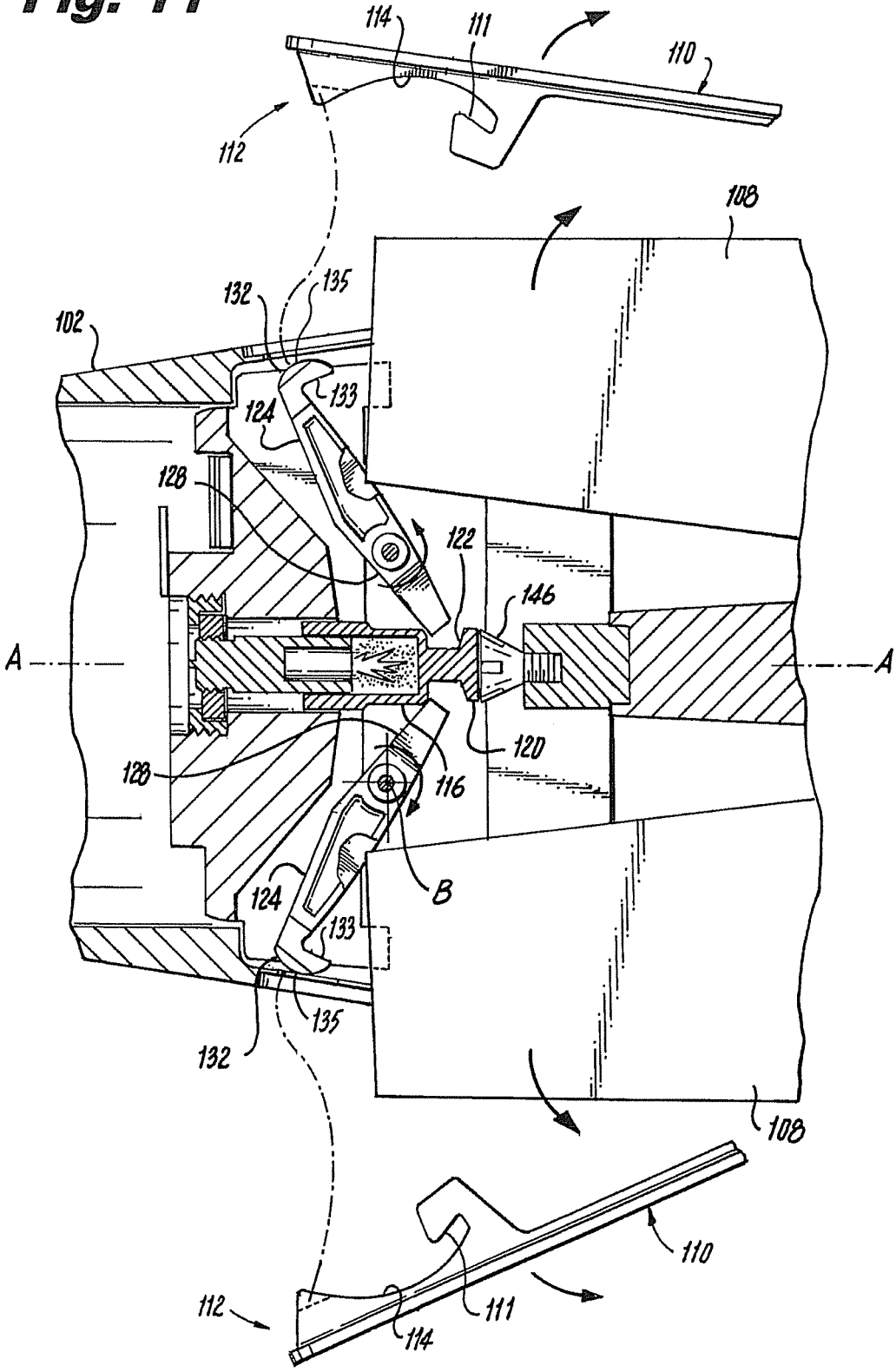
FIG. 11 is a cut-away side elevation view of the system as shown in FIG. 10, showing the canard covers ejected and the canards partially deployed.

Now with reference to FIGS. 6 and 7, each rocker arm 124 is configured and adapted to rotate relative to a respective rocker arm rotation axis B between a first position (FIG. 7) and a second position (FIG. 11). As shown in FIG. 7, in the first position, cover retaining surface 133 of latch element 132 is engaged with corresponding internal surface 111 of canard cover hook element 112 and second arm end 128 is retained by bobbin retaining surface 122. Cover retaining surface 133 of latch element 132 is configured and adapted to retain canard cover 110 by engaging with corresponding internal surface 111 of canard cover hook element 112 in the first position. A surface 140 formed on each rocker arm 124 defining the lower end of canard retaining slot 130 proximate second arm end 128 is configured and adapted to mechanically push associated canard 108 into the deployed position, while rocker arm 124 is transitioning (i.e. rotating relative to respective rocker arm rotation axis B) from the first position to the second position. The transition from the first position to the second position is described in further detail below with reference to FIGS. 10 and 11. Those skilled in the art will appreciate that interfacing latch element 132 and corresponding canard cover hook element 112 geometry is not susceptible to unlatching due to setback or setforward loading.

With continued reference to FIGS. 6 and 7, drive mechanism 134 for driving bobbin 116 is a pyrotechnic component 142 disposed within an axial bore 144 formed within first end 118 of bobbin 116. As shown in FIG. 7, pyrotechnic component 142 is shown in the inactive position. When activated, pyrotechnic component 142 is configured and adapted to initiate a force on bobbin 116 along longitudinal axis A causing bobbin 116 to move along longitudinal axis A relative to projectile housing 102. While shown in the exemplary context of having a single mechanism 134 providing force to a single channel, i.e. axial bore 144, those having skill in the art will readily appreciate that mechanism 134 could drive multiple channels and/or there could be multiple drive mechanisms 134. In addition, those having skill in the art will readily appreciate that drive mechanism 134 can be an explosive, motor or any other suitable mechanism to drive the bobbin.

Those skilled in the art will readily appreciate that drive mechanism 134 can be accessed through an end of projectile housing 102. This permits replacement of drive mechanism 134, therein allowing multiple deployment tests with minimum disassembly. In addition, those skilled in the art will readily appreciate that system 100 for retaining and deploying a plurality of canards and canard covers can be disposed in a small volume of tip portion 101 of projectile housing 102. This permits easier access and replacement with minimum disassembly.

Now with reference to FIG. 7, system 100 also includes an absorber 146 disposed adjacent to second end 120 of bobbin 116 along longitudinal axis A. Absorber 146 is configured and adapted to reduce shock to projectile housing 102 during deployment of canards 108 through activation of pyrotechnic component 142. While shown and described in the exemplary context of having an absorber 146 with a six-slot configuration, those skilled in the art will readily appreciate that the number of slots in absorber 146 can vary depending on the amount of energy absorbency preferred. Absorber 146 can be a crushable, replaceable element constructed from aluminum. Those skilled in the art will readily appreciate that absorber 146 can be made out of other materials such as copper, lead, plastic, rubber, solder, or any other suitable absorber material.

Figure 8:
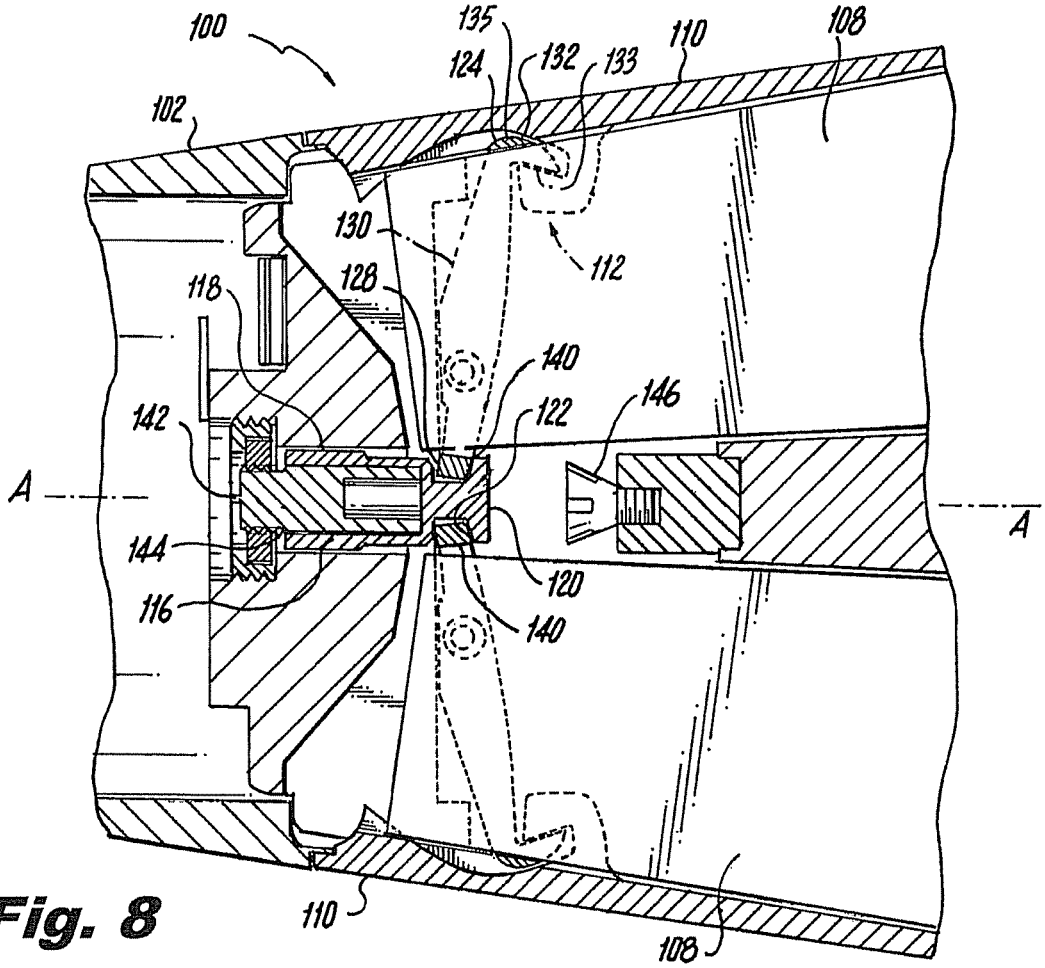
FIG. 8 is a cut-away side elevation view of a system for retaining and deploying a plurality of canards constructed in accordance with an embodiment present invention, showing the system and its components in the closed position.

Referring now to FIG. 8, canard 108 is shown in the closed position engaged with retaining slot 130 of rocker arm 124 in the first position (see also FIG. 7). Cover retaining surface 133 of latch element 132 is engaged with corresponding internal surface 111 of canard cover hook element 112, and second arm end 128 is engaged with bobbin retaining surface 122. The pyrotechnic component 142 disposed within an axial bore 144 formed within first end 118 of bobbin 116 has not been activated. Those skilled in the art will readily appreciate that the bobbin 116 in conjunction with the pyrotechnic component 142 provide a commonly initiated action that deploys all canard covers 110 within milliseconds of the initiation of pyrotechnic component 142 and subsequently ejects canards 108. The initiation of a single mechanism, e.g. drive mechanism 134 or pyrotechnic component 142, maintains the timing of the deployment ensuring that the deployment of one canard cover 110 is mechanically timed to deploy simultaneously with other canard covers 110 and the subsequent deployment of one canard 108 is mechanically timed to rapidly deploy simultaneously with the other canards 108.

Figure 9:
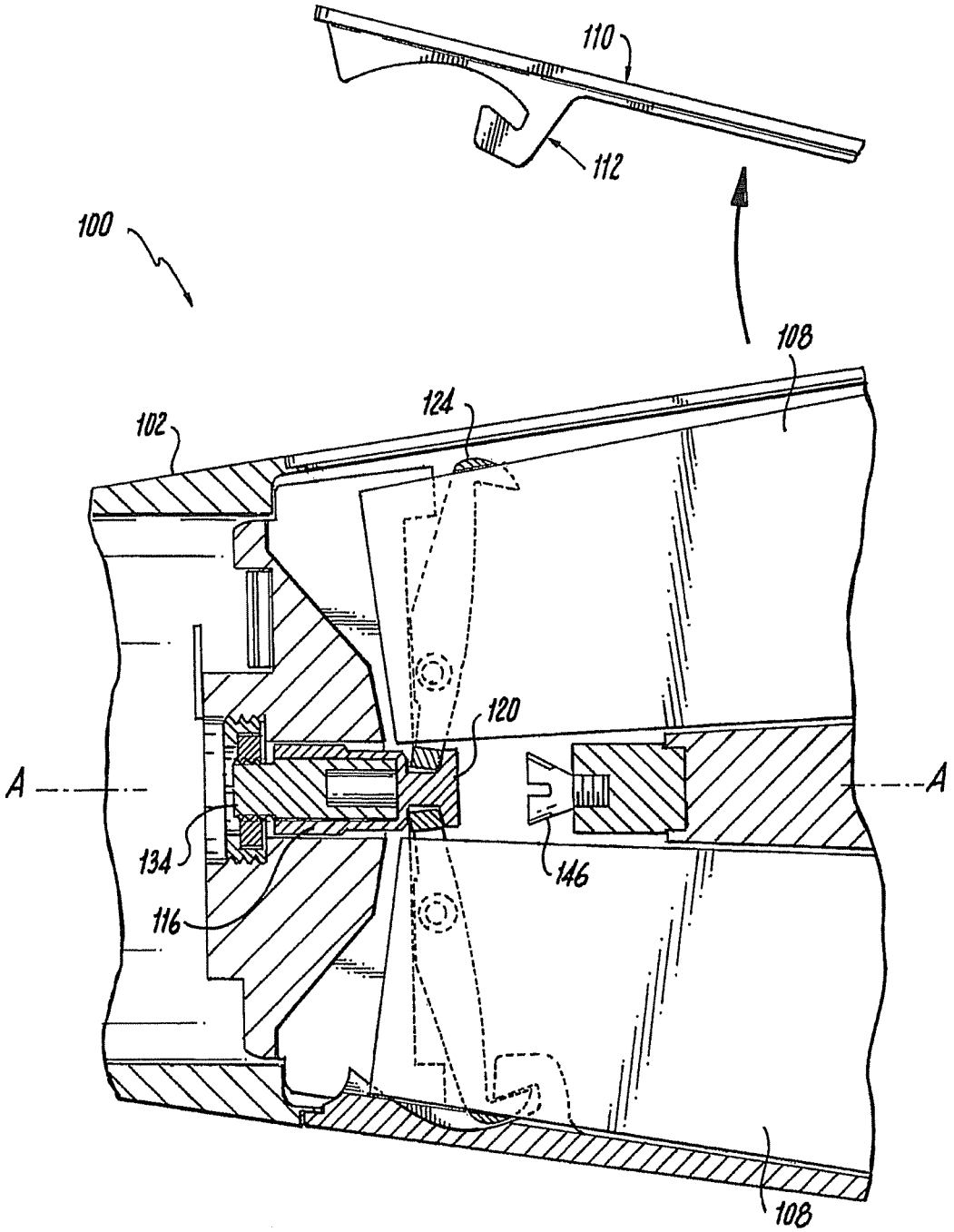
FIG. 9 is a cut-away side elevation view of an exemplary embodiment of a system for retaining and deploying a plurality of canards in accordance with the present invention, showing the system in the stowed position with the canards retained while a canard cover is accidentally removed.

Referring now to FIG. 9, those skilled in the art will readily appreciate that canards 108 can be retained by their respective rocker arm 124 even if their respective canard cover 110 is lost prior to the activation of drive mechanism 134. For example, during launch, if canard covers 110 are accidentally prematurely lost, canards 108 will not necessarily deploy because system 100 does not depend on canard covers 110 to retain canards 108. Those having skill in the art will readily appreciate that allows increased control over the projectile should covers 110 accidentally prematurely be lost.

With reference now to FIGS. 10 and 11, canards 108 are shown being deployed with canard covers 110 removed. As shown in FIG. 11, when activated, bobbin 116 moves along longitudinal axis A relative to projectile housing 102. The axial movement of bobbin 116 is translated into a rotational force on second arm end 128 of rocker arm 124 through the bobbin retaining surface 122, causing the rotation of rocker arm 124 relative to its respective rocker arm rotation axis B from the first to second position. From first position, as previously described with reference to FIGS. 7 and 8, to second position, as shown in FIG. 11, rocker arm 124 rotates about its respective rocker arm rotation axis B releasing canard cover 110. Although rocker arm 124 is shown in second position, the canards 108 are shown partially deployed. While releasing canard cover 110, cover ejection surface 135 of latch element 132 supplies a force on corresponding cammed surface 114 of canard cover hook element 112, forcing canard cover 110 outward and away from projectile housing 102 with enough force to clear projectile housing 102. As shown in FIG. 10, canard covers 110 are configured and adapted to be ejected from the projectile in a forward and radial outward direction to cause canard covers 110 to separate from projectile housing 102.

The invention also provides a method for ejecting a plurality of canard covers, e.g. canard cover 110, and deploying a plurality of canards, e.g. canards 108, on a projectile, e.g. projectile 102. The method includes driving a bobbin, e.g. bobbin 116, disposed within an interior chamber formed in the projectile longitudinally so as to cause a plurality of rocker arms, e.g. rocker arms 124, to rotate about a respective rocker arm axis, i.e. rocker arm rotation axis B. Each rocker arm defines a canard retaining slot, e.g. canard retaining slot 130, configured to secure the canard in a stowed position. The rotation of the rocker arms causes the ejection of the plurality of canard covers and the mechanically timed release and deployment of the plurality of canards. Those skilled in the art will appreciate that the release and deployment of the canards can be completed within milliseconds after initiating the mechanism to drive the bobbin, and that the release and deployment of each canard can be simultaneous with the release and deployment of the other canards. It is also envisioned that canards can be locked along a transverse axis D in the deployed position.

The methods and systems of the present invention, as described above and shown in the drawings, provide a system for retaining and deploying a plurality of canards and canard covers on a projectile with superior properties including increased synchronization of canard and canard cover deployment and canard retainment in case of accidental cover deployment. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A system for retaining and deploying a plurality of canards and canard covers on a projectile, the system comprising:

a) a projectile housing defining an interior chamber and a longitudinal axis;

b) a plurality of canards rotatably mounted to the housing and adapted for movement from a stowed position within the housing to a deployed position;

c) a plurality of canard covers, each including a hook element and each adapted to conceal respective slots formed in the projectile housing;

d) a bobbin movably disposed in the interior chamber of the housing along the longitudinal axis of the projectile housing, the bobbin having first and second ends, and a retaining surface defined proximate the second end;

e) a plurality of rocker arms rotatably mounted within the housing, each rocker arm having a first arm end and a second arm end, with a canard retaining slot defined therebetween configured to secure the canard in the stowed position, the first arm end including a latch element and the second arm end positioned proximate the bobbin retaining surface; and f) a mechanism for driving the bobbin along the longitudinal axis, so as to deploy the plurality of canards and canard covers on the projectile.

2. The system according to claim 1, wherein each rocker arm is configured and adapted to rotate relative to a respective rocker arm rotation axis between a first and second position.

3. The system according to claim 2, each latch element including a cover retaining surface, wherein in the first position the cover retaining surface is engaged with a corresponding internal surface of the corresponding canard cover hook element, the cover retaining surface configured and adapted to retain the corresponding canard cover over its respective slot formed in the projectile housing.

4. The system according to claim 2, wherein in the first position each second arm end is engaged with the bobbin retaining surface.

5. The system according to claim 2, wherein each rocker arm is forced to rotate relative to its respective rocker arm rotation axis into the second position when the bobbin moves along the longitudinal axis relative to the projectile housing, a cover ejection surface of the latch element of each rocker arm ejecting the respective canard cover and each canard retaining slot releasing the respective canard.

6. The system according to claim 1, wherein the mechanism for driving the bobbin is a pyrotechnic component disposed within an axial bore formed within the first end of the bobbin, configured and adapted to initiate a force on the bobbin along the longitudinal axis causing the bobbin to move along the longitudinal axis relative to the projectile housing, wherein the axial movement of the bobbin is translated into a force on the second arm end of each rocker arm causing the rotation of each rocker arm relative to a respective rocker arm rotation axis.

7. The system according to claim 1, further comprising an absorber disposed proximate to the second end of the bobbin along the longitudinal axis, configured and adapted to reduce shock to the projectile housing during deployment.

8. The system according to claim 1, wherein a surface formed on each rocker arm proximate the second arm end is configured and adapted to mechanically push the associated canard into the deployed position when the rocker arm rotates relative to a respective rocker arm rotation axis.

9. The system according to claim 1, wherein each of the canard cover hook elements includes a cammed surface.

10. The system according to claim 1, wherein each of the canard cover hook elements includes an internal surface.

11. The system according to claim 1, wherein each of the canard covers includes a main body section having forward and aft ends and a groove proximate the aft end, wherein the groove is removably engaged with projectile housing, and the canard cover hook element is defined between the forward and aft ends, proximate to the forward end.

12. The system according to claim 1, wherein each of the canard covers are configured and adapted to eliminate drag on the projectile housing.

13. The system according to claim 1, wherein the system is disposed in a tip portion of the projectile housing.

14. The system according to claim 1, further comprising a crushable replaceable absorber disposed proximate to the second end of the bobbin along the longitudinal axis, configured and adapted to reduce shock to the projectile housing during deployment.

15. The system according to claim 1, wherein each canard is configured and adapted to rotate about a respective fulcrum and in a respective plane passing through the longitudinal axis.

16. The system according to claim 1, wherein the canards are configured to be released and deployed simultaneously with one another.

17. The system according to claim 1, wherein each of the canards is configured and adapted to be locked along a respective transverse axis in the deployed position.

18. A method for ejecting a plurality of canard covers and deploying a plurality of canards on a projectile, the method comprising the steps of:

driving a bobbin disposed within an interior chamber formed in the projectile longitudinally so as to cause a plurality of rocker arms to rotate about a respective rocker arm axis, each rocker arm defining a canard retaining slot configured to secure the canard in a stowed position, wherein the rotation of the rocker arms causing the ejection of the plurality of canard covers and the subsequent mechanically timed release and deployment of the plurality of canards.

19. The method according to claim 18, wherein the release and deployment of each of the canards is simultaneous with one another.

20. A system for retaining and deploying a plurality of canards and canard covers on a projectile, the system comprising:

a) a projectile housing defining an interior chamber and a longitudinal axis;

b) a plurality of canards rotatably mounted to the housing, wherein each canard is configured and adapted to rotate about a respective fulcrum and in a respective plane passing through the longitudinal axis from a stowed position within the housing to a deployed position;

c) a plurality of canard covers, each including a hook element and each adapted to conceal respective slots formed in the projectile housing, through which the respective canards rotate from the stowed position within the housing into the deployed position;

d) a bobbin movably disposed in the interior chamber of the housing along the longitudinal axis of the projectile housing, the bobbin having first and second ends, and a retaining surface defined proximate the second end;

e) a plurality of rocker arms rotatably mounted within the housing, each rocker arm having a first arm end and a second arm end, with a canard retaining slot defined therebetween configured to secure the canard in the stowed position, the first arm end including a latch element and the second arm end positioned proximate the bobbin retaining surface, wherein each rocker arm is configured and adapted to rotate relative to a respective rocker arm rotation axis between a first and second position; and f) a mechanism for driving the bobbin along the longitudinal axis, the driving mechanism configured and adapted to initiate a force on the bobbin causing the bobbin to move along the longitudinal axis relative to the projectile housing, wherein the movement of the bobbin is translated into a force on the second arm end of each rocker arm causing the rotation of each rocker arm relative to its respective rocker arm rotation axis from the first position to the second position, the rotation of the rocker arms releasing the respective canards from their canard retaining slots and mechanically pushing each of the respective canards into the deployed position.

* * * * *